US007455480B2

(12) United States Patent
Melegari

(10) Patent No.: US 7,455,480 B2
(45) Date of Patent: Nov. 25, 2008

(54) METHOD FOR THE CONSTRUCTION OF DRAINAGE WORKS, IN PARTICULAR FOR THE STABILISATION OF SLOPES AND/OR TERRAIN WHICH ARE UNSTABLE OR SUBJECT TO LANDSLIDES

(76) Inventor: Cesare Melegari, Via Boschi 25, Noceto (PR) (IT)

( * ) Notice: Subject to any disclaimer, the term of this patent is extended or adjusted under 35 U.S.C. 154(b) by 0 days.

(21) Appl. No.: 11/905,535

(22) Filed: Oct. 2, 2007

(65) Prior Publication Data

US 2008/0080931 A1 Apr. 3, 2008

(30) Foreign Application Priority Data

Oct. 2, 2006 (IT) ..... PC2006A000043

(51) Int. Cl.
*E02D 3/00* (2006.01)

(52) U.S. Cl. ..... 405/302.4; 405/43; 405/51; 405/50

(58) Field of Classification Search ..... 405/43–45, 405/50, 51, 302.4
See application file for complete search history.

(56) References Cited

U.S. PATENT DOCUMENTS 599,719 A * 3/1898 Manning ..... 405/50
1,142,125 A * 6/1915 Sooy ..... 405/43
1,866,826 A * 7/1932 Strothmann ..... 405/45
3,667,236 A * 6/1972 Rosene ..... 405/50
4,714,376 A * 12/1987 Jenab ..... 405/45
4,820,080 A * 4/1989 Varkonyi et al. ..... 405/45
4,988,235 A * 1/1991 Hurley ..... 405/50

* cited by examiner

*Primary Examiner*—Frederick L Lagman
(74) *Attorney, Agent, or Firm*—Young & Thompson

(57) ABSTRACT

A method for the stabilization of slopes and/or terrain which are unstable or subject to landslides, by inserting drainage devices. A vertical shaft with a concrete lining or a microtunnel (1) is constructed and an automatic drilling unit (8) is position therein. The drilling unit has at least one drilling head (6), a magazine of rods (11), and robotic devices able to pick up the rods (12) from the magazine and take them to the drilling head, the rods (12) being constituted by the drainage pipes (5); the head is controlled to perform drilling operations, with simultaneous laying of the drainage pipe. The drainage pipes are constituted by a tubular steel element, whose walls contain holes which house a microfiltration valve filled with water-soluble material to prevent the passages from becoming obstructed during drilling; when the pipe has been laid, the water-soluble material dissolves, thus cleaning the passages.

9 Claims, 4 Drawing Sheets

METHOD FOR THE CONSTRUCTION OF DRAINAGE WORKS, IN PARTICULAR FOR THE STABILISATION OF SLOPES AND/OR TERRAIN WHICH ARE UNSTABLE OR SUBJECT TO LANDSLIDES

BACKGROUND OF THE INVENTION

This invention relates to a method for the stabilization of slopes and/or terrain which are unstable or subject to landslides, by inserting suitable drainage devices.

In particular, a vertical shaft with a concrete lining or a microtunnel is constructed in an area of ground predefined by a suitable geological study, and an automated drilling unit is positioned in the microtunnel or vertical shaft.

Said drilling unit comprises at least one drilling head, a magazine of rods, and robotic devices able to pick up the rods from the magazine and take them to said drilling head, said rods being constituted by said drainage pipes; said head is then controlled to perform drilling operations, with simultaneous laying of the drainage pipe.

In accordance with an advantageous aspect of the invention, said drainage pipes are constituted by a tubular steel element, the walls of which contain holes, each of which said holes houses a microfiltration valve. Said holes are filled with water-soluble material to prevent the passages from becoming obstructed during drilling; when the pipe has been laid, the water-soluble material dissolves, thus clearing said passages.

In this way, drainage pipes can be laid directly in unstable terrain in a fully automatic manner, with no need for the operators to access the terrain, and therefore with no risk to them.

In this patent application, and in particular in the claims, the term "shaft" is used to indicate both a vertical shaft and a microtunnel.

In order to stabilize slopes affected by surface phenomena or actual gravitational movements of the mass, suitable devices are often installed to drain off the water circulating in the mass of debris.

Technologies known according to the state of the art involve the construction of drainage trenches, sub-horizontal drains, drainage tunnels or drainage shafts.

These technologies require a major investment in human and material resources, and are therefore very expensive. Drainage systems are also known which involve inserting in the ground drainage pipes consisting of metal or plastic pipes containing holes for the passage of water.

A number of said drainage pipes are inserted into the ground up to the required depth, spaced at a suitable distance apart.

SUMMARY OF THE INVENTION

To solve the problems indicated above, this innovation now offers a method for the stabilization of unstable terrain and/or slopes by inserting drainage pipes. Said method involves the construction of a microtunnel or a vertical shaft in an area predefined by a suitable geological study, and the positioning in said microtunnel or vertical shaft of an automated drilling unit with equipment which, as the machine advances down the vertical shaft or along the microtunnel, drills through the concrete lining and inserts drainage pipes into the soil to be drained.

Automated control systems and suitable video cameras allow the operators to check the machine remotely and to lay the necessary drainage pipes without having to access areas of unstable ground.

BRIEF DESCRIPTION OF SEVERAL VIEWS OF THE DRAWINGS

This invention will now be described in detail, by way of example but not of limitation, by reference to the annexed figures wherein.

DETAILED DESCRIPTION OF THE PREFERRED EMBODIMENTS

Figure 1:
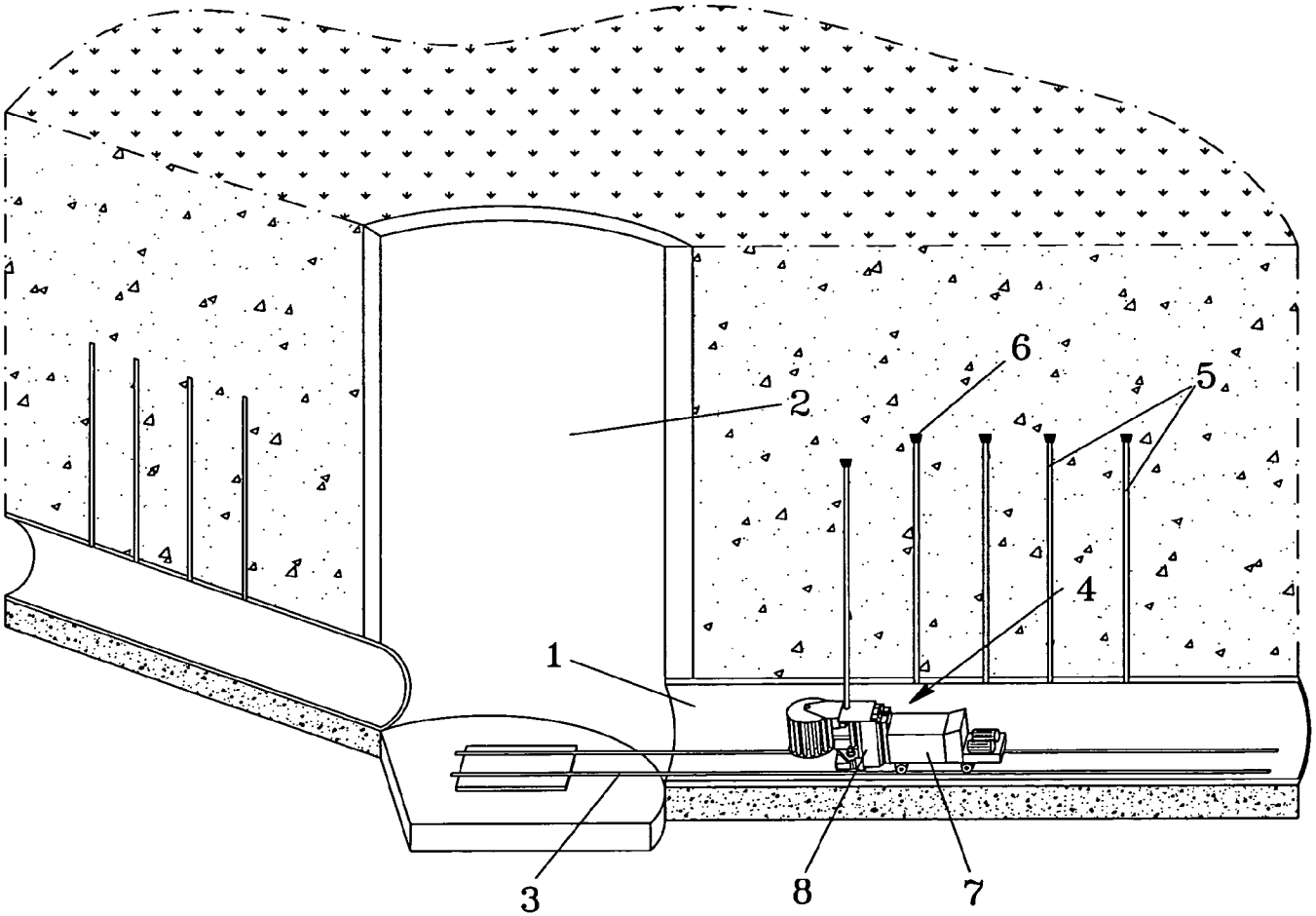
FIG. 1 schematically illustrates a cross-section of ground during drainage operations using the method according to the invention, as the machine advances along a microtunnel.

FIG. 1 illustrates the method according to the invention, wherein the machine is caused to advance along a microtunnel 1, which in the case illustrated is constructed below the main slip plane of the landslide movement and which is accessed, for example, from a vertical shaft 2. Both the microtunnel and the vertical shaft have a lining consisting of a layer of concrete of suitable thickness.

Robotic machine 4, which inserts drainage pipes 5 into the ground, moves on rack rails 3 laid in the microtunnel, which may be positioned laterally to the area to be drained or in another suitable area of stable ground.

In accordance with an advantageous aspect of the invention, said drainage pipes also act as drilling rods, and are therefore fitted at the head with a sacrificial bit 6.

Figure 3:
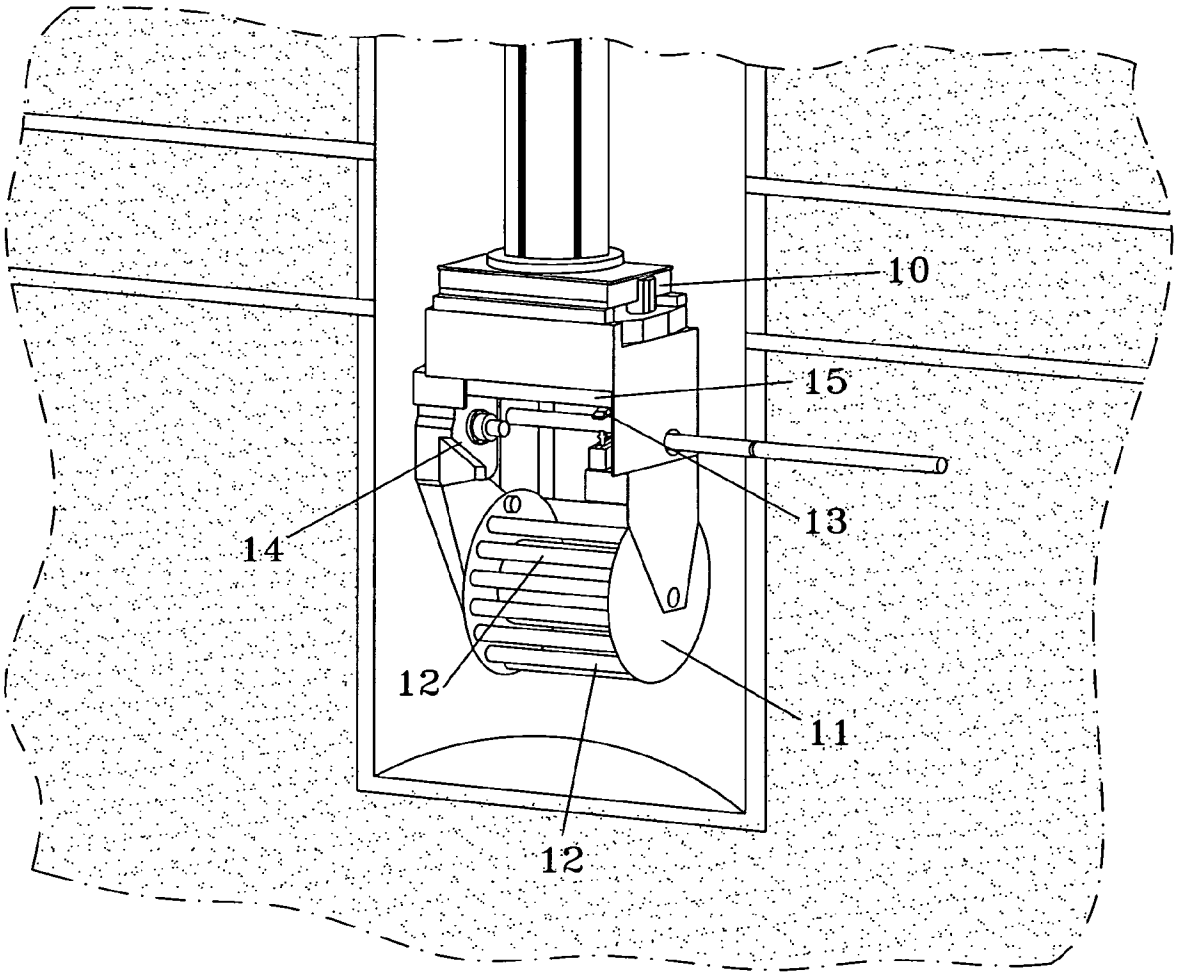
FIG. 3 is an enlarged detail from FIG. 2, which schematically illustrates a machine that can be used to implement the method according to the invention.

Machine 4 consists of a drive unit 7 which, by means of electric motors, causes it to advance along rails 3, and a drilling unit 8, which said unit is illustrated in detail in FIG. 3.

FIG. 3 only shows the drilling unit, because the machine hangs from a structure that lowers it into a vertical shaft; a motor is therefore not required to control its advance.

As shown in FIG. 3, the structure of the machine, shown as 10, is fitted with a magazine 11 holding a plurality of drainage pipes/drilling rods 12, and a robotic system 13 that picks up rods 12 from magazine 11 and takes them to a rotary head 14, which engages the rods, causes them to rotate, and pushes them forwards, running along a guide 15.

As the individual components, such as the rotary head, the couplings that connect the rods to it, and the drainage pipes, would be known to one skilled in the art, a detailed description thereof is not necessary.

The various stages of the method according to the invention will now be described by reference to FIG. 1.

When the lengths of the drainage pipes and the position and direction of said pipes has been determined, work begins; machine 4 enters the tunnel and takes up a position in the area where the first pipe is to be laid.

Using one or more video cameras installed on the machine, the operator can monitor the correct performance of the operations and manage the entire process of drilling and laying of drainage pipes remotely, from a control board.

Said operation begins when robot 13 picks up a first drilling rod, called the "core barrel", from magazine 11, and positions it on rotary head 14.

This is followed by core boring, which culminates in drilling through the concrete wall of the microtunnel.

The core barrel is replaced in the magazine, and the machine picks up the first rod or drainage pipe, which is suitably equipped with a disposable bit and a preventer (safety shutter) 20, and fits it on the rotary head. This starts the rotation of the unit, which advances and simultaneously drills the ground and inserts the preventer under pressure into the concrete wall of the microtunnel.

When the first rod has been fully inserted, the machine automatically picks up a second rod from the magazine and loads it onto head 14 which, as it advances, screws it onto the rod already inserted in the ground and advances, continuing with drilling and inserting the second rod into the ground.

Work continues in this way until the required depth is reached, whereupon the machine picks up a "rod-pusher" (of known type) from the magazine and uses it to push the last section of the rod or drainage pipe into the hole, causing it to advance until it is flush with the tunnel wall, thus allowing the machine to return to the rest position with no risk of collision. The insertion of the first drainage pipe having thus been completed, the machine returns to the starting position. The operator loads a new set of rods into the magazine and then controls the advance of the machine to the point of insertion of the second drainage pipe, repeating all the operations described above.

It is thus possible to lay a plurality of drainage pipes in the ground without the operator having to access the inside of the shaft.

Figure 2:
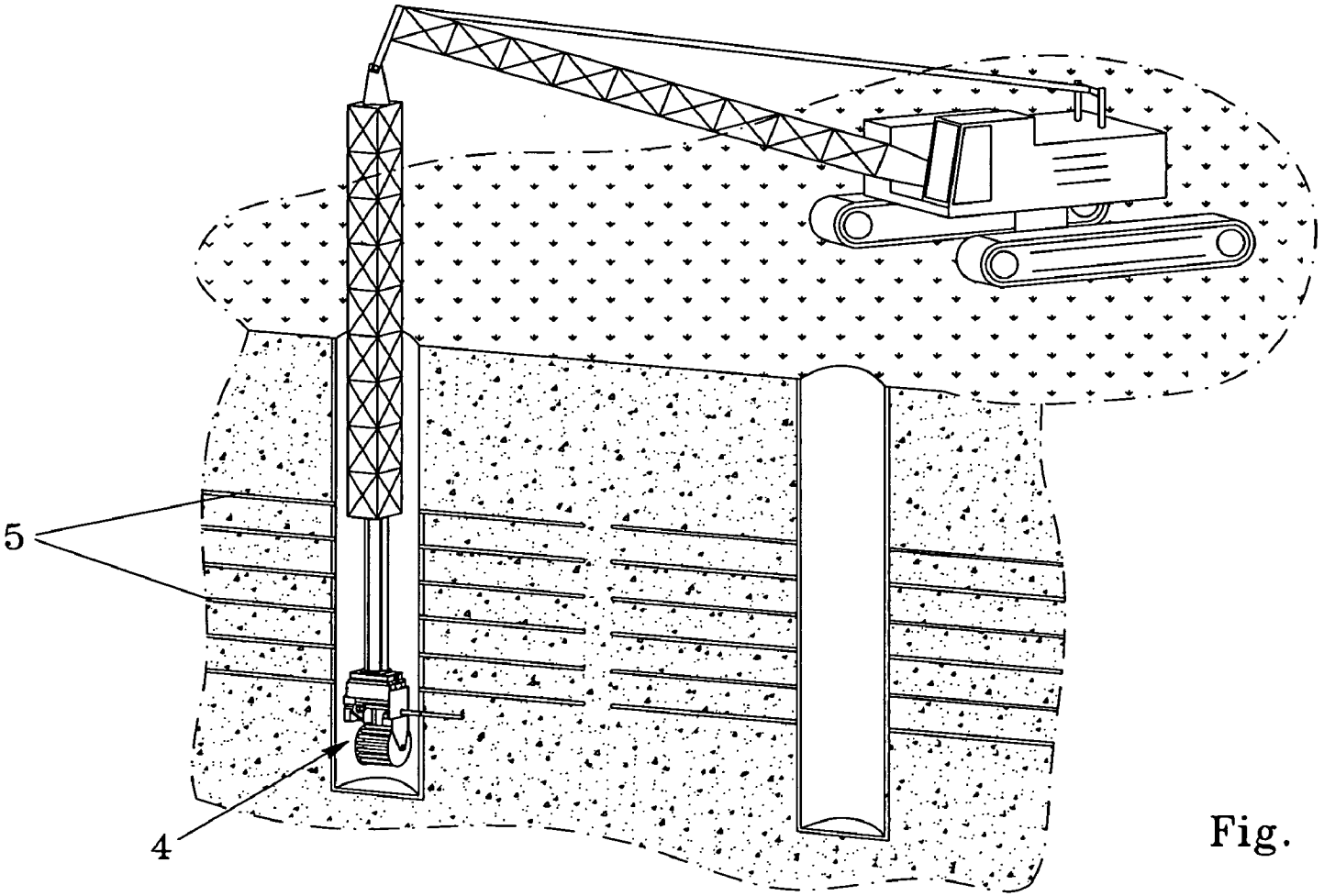
FIG. 2 schematically illustrates a cross-section of the ground to be stabilized, during stabilization operations performed by lowering the robotic equipment down a vertical shaft.

In accordance with a second preferred embodiment of the invention, illustrated in FIGS. 2 and 3, the method according to the invention involves inserting the machine into a vertical shaft or vertical tunnel, and repeating the same operations to insert a plurality of drainage pipes into the ground, but this time laying them substantially horizontally.

In this case the machine will be advantageously hung from a crane, so that it can be inserted in the vertical shaft.

Figure 4:
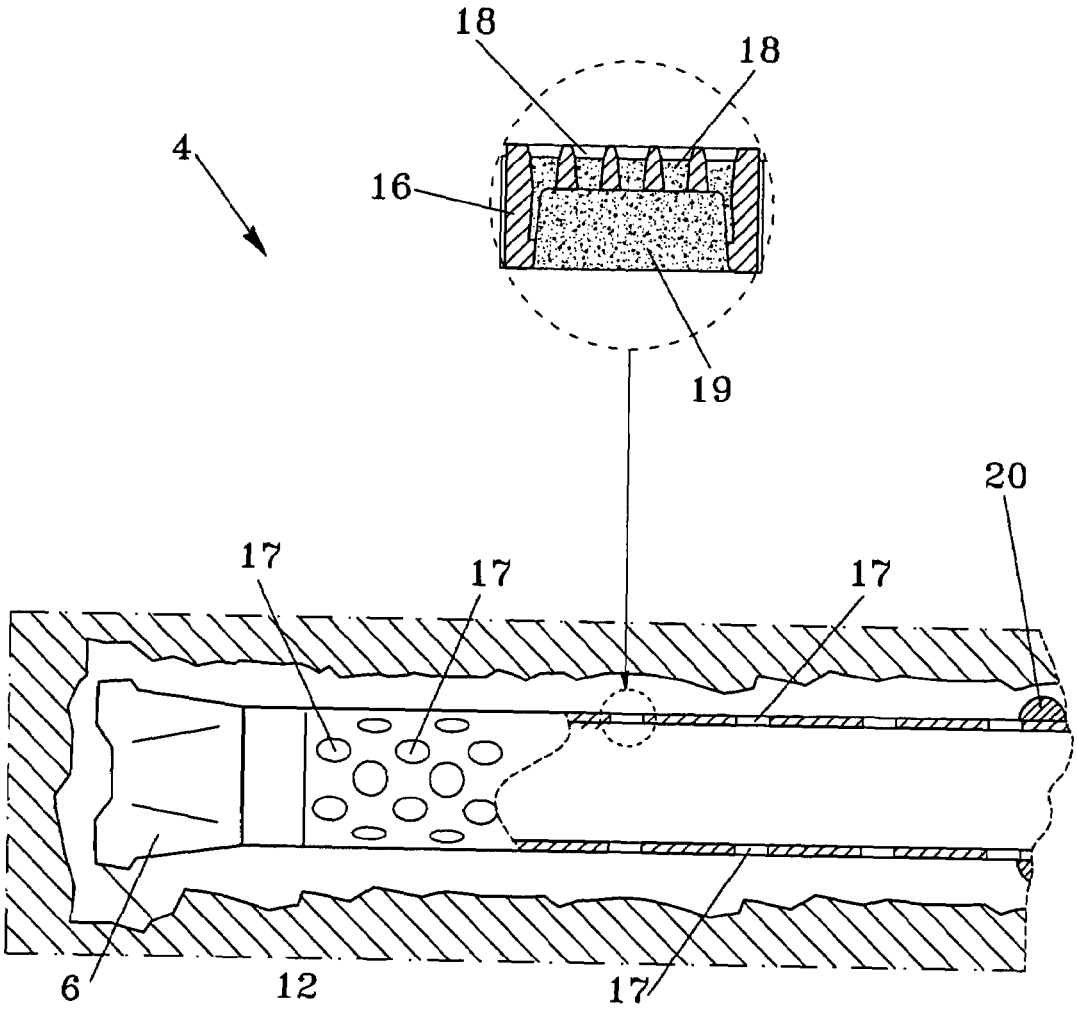
FIG. 4 schematically illustrates an example drainage pipe inserted into the ground according to the invention.

In accordance with a further characteristic of the invention, the drainage pipes consist of steel pipes of suitable thickness, with drainage holes having a diameter of approx. 10-20 mm. in the wall thereof, a microfiltration valve with holes having a diameter of approx. 1 mm being inserted into each hole. A possible example of said valves, illustrated in FIG. 4, is constituted by a threaded cap 16 which is screwed into hole 17 in the rod and which in turn contains a plurality of holes 18 for the passage of liquid.

The body of cap 16 is hollow, for example with a cone-frustum-shaped cavity or, preferably, with an undercut.

Said cavity is filled with a layer of water-soluble material 19, preferably water-soluble plastic, which also fills holes 17, preventing them from becoming obstructed by debris during the soil-drilling stage.

With this system the drainage pipe acts as a drilling rod at the drilling stage, because the microfiltration valves, effectively embedded in the steel pipe, are protected by the water-soluble plastic.

This configuration also allows the drilling fluid directed towards the bit to be pumped through the rod at the necessary pressure, without any need for a specific pipe.

The water-soluble plastic used to protect the valves is a polyvinyl-alcohol-based polymer which is water-soluble and biodegradable in a moist environment, and has proved particularly suitable for this type of application.

The method according to the invention greatly simplifies the operation of drilling and laying of a drainage pipe, which is performed almost fully automatically without any risk to the operators, who can control all the operations while remaining outside the area of unstable ground.

Although this method is mainly designed to stabilize landslide movements, it could also be effectively used in other applications, such as drainage of percolates in contaminated areas, to increase the uptake capacity of groundwater to be conveyed to aqueducts, or as a drilling system for the injection of grout and other mixtures, for the purpose of consolidation with the jet-grouting or conventional grouting technique.

The invention claimed is:

1. Method for the construction of drainage works to stabilize ground which is unstable and/or liable to landslides, for the drainage of percolates in contaminated areas, to increase the uptake capacity of groundwater to be conveyed to aqueducts, or as a drilling system for the injection of grout and other mixtures for the purpose of consolidation with the jet-grouting or conventional grouting technique, the method comprising the steps of:

constructing a shaft in a position which the ground is stable;

inserting an automated drilling unit (8) into the shaft;

drilling and inserting one or more drainage pipes (5) into the area to be drained, starting from said shaft;

pick-up of a drilling rod (12) from a magazine (11) by a robot (13), and positioning of said rod on a rotary head (14);

drilling the concrete shaft wall by core boring;

pick-up of a rod fitted with a disposable bit (6) and a preventer (20) from a magazine (11), and mounting thereof on said rotary head (14);

rotating and simultaneous advancing of the head, with drilling of the soil and pressurised insertion of the preventer in the concrete wall of the shaft;

pick-up of a second rod (12) from the magazine and loading of said rod onto the head (15) which, as it advances, screws said rod onto the rod already inserted in the ground and advances further, continuing to drill and inserting the second rod in the ground;

repetition of the last stage until the required depth is reached; and returning the machine to the starting position for loading of a new set of rods into the magazine, and advance of the machine to the point at which the next drainage pipe is to be inserted.

2. Method as claimed in claim 1, wherein:

the wall of said shaft (1) is drilled with a coring rod;

when the coring rod has been removed, drilling begins with a rod fitted with a disposable bit (6) and a preventer which is inserted into the hole in the shaft wall during the advance of the rod;

a second rod (12) is connected to the one already inserted in the ground and drilling continues, rods (12) being added from time to time until the required depth is reached.

3. Method as claimed in claim 2, wherein the drainage pipe is used as a drilling rod.

4. Method as claimed in claim 3, wherein said drainage pipe (5) present a plurality of holes (17) closed by valves consisting of perforated elements (16) filled with water-soluble material (19) which is designed to prevent the holes (17) from becoming obstructed during drilling, and subsequently dissolves on contact with water.

5. Method as claimed in claim 2, wherein said microtunnel (1) is constructed in soil strata below the area affected by gravitational movements.

6. Equipment for the implementation of the method as claimed in claim 1, which includes a machine comprising:

a magazine (11) of drilling rods (5);

a rotary head (14);

means designed to cause said rotary head (14) to slide in a direction orthogonal to the direction of advance of the machine;

means designed to pick up a rod (5) from said magazine (11) automatically, at intervals, and fit it onto said rotary head (14);

said machine being equipped with means which cause it to advance along rails position in a microtunnel.

7. Machine as claimed in claim 6, which includes means designed to hang it from lifting devices able to lower it into a vertical shaft.

8. Method as claimed in claim 1, wherein said shaft is constituted by a microtunnel (1) external to the area to be drained, and is constructed in soil strata not affected by gravitational movements.

9. Method as claimed in claim 1, wherein said shaft (1) consists of a vertical shaft constructed in the soil stratum to be drained, and that the drainage pipes (5) are inserted into the ground from said vertical shaft (1).

* * * * *